US006472619B1

(12) United States Patent
Halphide

(10) Patent No.: US 6,472,619 B1
(45) Date of Patent: Oct. 29, 2002

(54) CONTROL LOCK FOR A TOGGLE SWITCH

(76) Inventor: Kenneth Halphide, 134 Jackson View Dr., Chehalis, WA (US) 98532

( * ) Notice: Subject to any disclaimer, the term of this patent is extended or adjusted under 35 U.S.C. 154(b) by 0 days.

(21) Appl. No.: 09/829,613

(22) Filed: Apr. 11, 2001

(51) Int. Cl.[7] ..... H01H 9/28
(52) U.S. Cl. ..... 200/43.16
(58) Field of Search ..... 200/43.01, 43.11, 200/43.16, 43.19, 43.21, 43.22, 318, 327, 333, 334

(56) References Cited

U.S. PATENT DOCUMENTS 4,876,425 A * 10/1989 Woskow ..... 200/43.16
5,260,528 A * 11/1993 Benda ..... 200/43.14
5,278,365 A * 1/1994 Rowley et al. ..... 200/43.16
5,324,897 A * 6/1994 Melgoza et al. ..... 200/43.11
5,468,925 A 11/1995 Mohsen ..... 200/43.22
5,558,209 A 9/1996 Mohsen ..... 200/43.22
5,624,022 A * 4/1997 Paulson ..... 200/327
5,723,832 A * 3/1998 Hall ..... 200/43.16

* cited by examiner

*Primary Examiner*—Michael Friedhofer
(74) *Attorney, Agent, or Firm*—Thomas W. Secrest

(57) ABSTRACT

An inexpensive control lock or locking device for preventing changing the state of a toggle switch from an open circuit to a closed circuit or from a closed circuit to an open circuit. The control lock bears against the projecting lever of a toggle switch to prevent movement of the projecting lever and thereby prevents changing the state of the toggle switch.

6 Claims, 3 Drawing Sheets

CONTROL LOCK FOR A TOGGLE SWITCH

CROSS-REFERENCES TO RELATED PATENT APPLICATIONS (if any)

This is not applicable to the subject patent application as there is no cross-reference to a related patent application.

STATEMENT REGARDING FEDERALLY SPONSORED RESEARCH AND DEVELOPMENT

This invention was developed with private money and private funds.

REFERENCE TO A MICROFICHE APPENDIX

This section is not applicable to this patent application.

BACKGROUND OF THE INVENTION

1. Field of the Invention

This invention is directed to a switch and in particular to a toggle switch. The invention is directed to restricting the movement of a toggle switch.

The switch is a circuit element that has two states, viz., on and off. When on, the switch allows electrical signals to pass unimpeded. When off, the switch does not allow electrical signals to pass. A switch can be a mechanical switch such as a household light switch which is a toggle switch.

A toggle switch is a switch in which a projecting lever with a spring is used to open or to close an electric circuit.

In some situations, it is desirable to have an electric circuit always open.

In other situations, it is desirable to have the electric circuit always closed.

An example of an always open electric circuit can be a photographic dark room. In the photographic dark room, the electric light should be off so as not to interfere with the processing of the film. It is desirable to have a control lock for insuring that the circuit in a photographic dark room will be an open circuit. There should be provision for prohibiting accidental closing of the electric circuit and activation of the electric light.

Another example of having an always open electric circuit is to prevent the accidental closing of an electric circuit for operating an electric motor. It may be desirable at times to make sure that the electric motor will not operate. By having the toggle switch in an open circuit configuration, the electric motor will not operate.

In other situations, it is desirable to have an always closed electric circuit. In certain situations it is desirable to have an electric light on continuously.

Also, in some situations, it is desirable to have an electric motor always operating.

In other situations, it is desirable to have a motion detector in a closed circuit with the closed circuit being continuously closed.

Another situation where there should be a continuous closed circuit is with a surveillance camera.

An electric circuit may comprise a photocell for detecting light. It is often desirable for the electric circuit to be in a closed state so that the photocell can close or open the electric circuit.

Another situation with an always closed circuit could be with medical apparatus to make sure that the medical apparatus will function continuously.

The inventor would have friends over to his house. The inventor would have a closed circuit or an open circuit. One of the friends would open a closed circuit to the annoyance of the inventor. One of the friends would close an open circuit to the annoyance of the inventor. As a result, the inventor developed the subject invention or the control lock for the toggle switch.

Friends of the inventor could come over to his house and try to move the projecting lever for the toggle switch. Since the inventor had put the control lock on the toggle switch, the toggle switch could not be moved. As a result, a closed circuit remained a closed circuit and an open circuit remained an open circuit.

2. Description of the Related Art

Prior to preparing this patent application, the inventor made a patent search at the University of Washington Engineering Library in Seattle, Washington.

In this patent search, there were two United States patents:

| PATENTEE | NUMBER | ISSUING DATE |
|---|---|---|
| MOHSEN | 5,468,925 | 1995 NOVEMBER 21 |
| MOHSEN | 5,558,209 | 1996 SEPTEMBER 24. |

These two patents are directed to a locking device for an electric toggle switch.

The locking device prevents the toggle from changing its state from a closed circuit to an open circuit or changing its state from an open circuit to a closed circuit.

In order to change the state of the toggle switch, it is necessary to remove the locking device from the toggle switch and then reset the toggle switch. Then the locking device is placed over the toggle switch to prevent movement of the toggle switch and the change of state. This operation requires a few minutes and is inconvenient in the setting of the toggle switch to a new position.

BRIEF SUMMARY OF THE INVENTION

The control lock of this invention is of a relatively thin material. The control lock must be sufficiently long so as to accommodate the projecting lever of the toggle switch and also the fastening means to the toggle switch.

In essence, the control lock is of relative thin material having a central opening through which projects the projecting lever of the toggle switch. Then, the control lock may have two separate openings or slots for receiving the two screws connecting the control lock to the toggle switch.

In a household unit with a toggle switch, there is a receptacle for holding the toggle switch. Then there is a toggle switch. Usually there is a cover plate over the toggle switch. There are two screws for attaching the cover plate to the toggle switch. With this invention and control lock, there is provision for the two screws to project through the control lock and to fasten the control lock to the cover plate and to the toggle switch.

In order to attach the control lock to the cover plate and the toggle switch, it is necessary to have openings in the control lock.

One version of the control lock is to have three openings. The central opening is a large central opening for receiving the projecting lever of the toggle switch. Then, on one end of the large central opening, there is a long slot for receiving the screws to attach the control lock to the cover plate and to the toggle switch. Further, there is a another long slot for attaching another screw to the cover plate and the toggle switch. In this version, there are three long slots. It is possible for a person to take a screw driver and loosen the two screws attaching the control lock to the cover plate and to the toggle switch. The projecting lever of the toggle switch can be moved and the control lock can be moved so that the control lock is abutting the projecting lever of the toggle switch. Then, the two screws can be tightened and the control lock prevents the movement of the toggle switch.

In another version, there may be one long slot for receiving the projecting lever of the toggle switch and making provision for attaching two screws to the protective cover and to the toggle switch to definitely position the control lock on the toggle switch and to prevent movement of the projecting of the toggle switch.

The control lock can be made of various material such as plastic. The plastic may be plain or colored or have a material for reflecting light waves.

The control lock may be made of metal. The control may be made of veneers of wood. Also, the control lock can be made of veneers of pressed paper such as formica.

The control lock may be relatively long, relatively narrow and relatively thin, and may be of less width than the toggle switch.

The control lock may be relatively long, relatively wide and relatively thin, and may be larger than the normal cover plate for the household electric toggle switch.

The main feature of the control lock is to be able to loosen the screws attaching the control lock, the cover plate to the toggle switch without removing the control lock from the toggle switch. In other words, to set the control lock to a desired position, the two screws attaching the control lock to the toggle switch are loosened and the control lock moved. This operation requires approximately one minute and does not necessitate the removal of the control lock from the toggle switch and the cover plate. The inventor considers this to be a good advantage over the prior art as there is less possibility of losing the screws which attach the control lock to the cover plate. Also, the inventor considers this to be a good advantage as it requires less time to loosen screws, move the control lock, and then tighten screws that is required to remove a locking device from the toggle switch, reset the toggle switch and attach the locking device to the toggle switch. In fact, the screws are quite often lost when removed from the toggle switch. The screws may be dropped on the floor or dropped and roll away.

OBJECTS AND ADVANTAGES

One of the objects of advantages of this control lock is unitary and continuous;

Another object and advantage is that the control lock is inexpensive to manufacture;

Another advantage is that the control lock is easy to install on a toggle and onto the toggle switch in the mounting receptacle;

Another advantage is that the control lock is easy to use and can be used with an ordinary screw driver and a toggle switch;

Another advantage is that it is easy to change the position or setting the control lock with respect to the projecting lever of the toggle switch;

Another important advantage is that while changing the position of the control lock with respect to the toggle switch, the control lock can remain on the toggle switch;

Another advantage is that the control lock can be decorative and of various designs;

Another advantage is that it can be of a clear or desired color or be of an illuminated material to glow in the dark; and Additional objects, advantages and novel features of the invention will be set forth in part in the description which follows, and in part will become apparent to those skilled in the art upon examination of the following or may be learned by the practice of the invention. The objects and advantages of the invention may be realized and attained by means of the instrumentalities and combinations particularly pointed out in the appended claims.

DETAILED DESCRIPTION OF THE INVENTION

Figure 1:
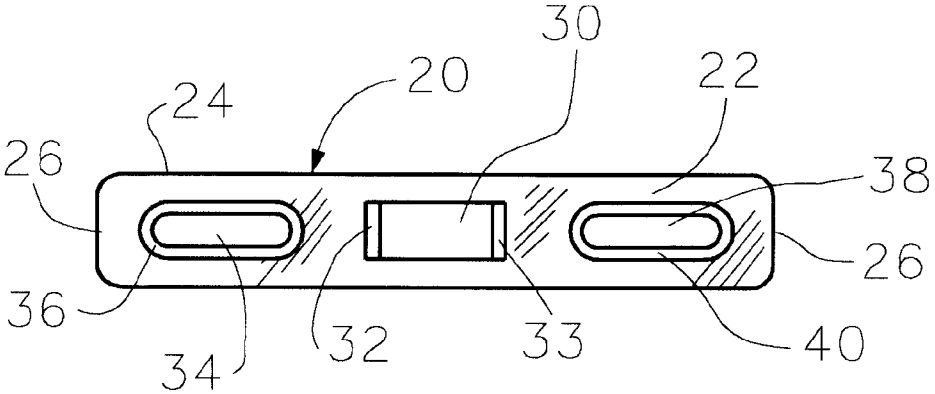
FIG. 1 is a top plan view of one version of the control lock and illustrates three openings in the control lock and is of a relatively narrow construction.
Figure 2:
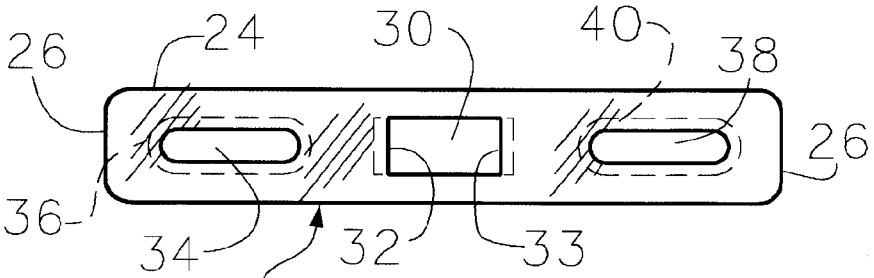
FIG. 2 is a bottom plan view of the control lock of FIG. 1.
Figure 3:
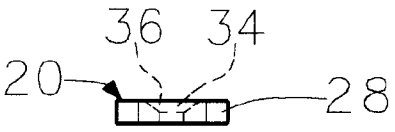
FIG. 3 is an end elevational view of the control lock of FIG. 1.
Figure 4:
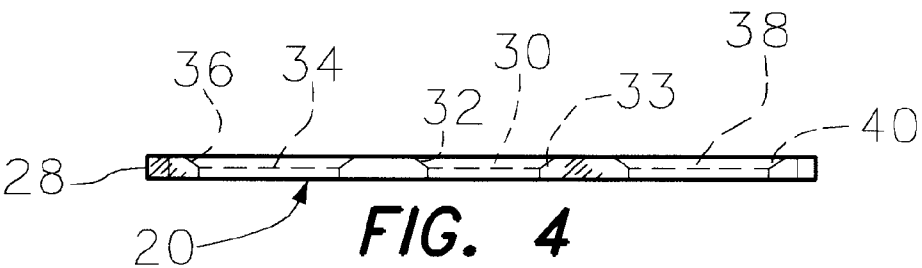
FIG. 4 is a side-elevational view of the control lock of FIG. 1.

In FIGS. 1–4, it is seen that there is a control lock 20 which is relatively long with respect to its width and which is relatively thin with respect to its width and with respect to its length.

The control lock 20 may be a strip of material 22. The control lock 20 has a length 24 and a width 26 and a thickness 28.

There is a central opening 30 or a first opening 30 for receiving a projecting lever of a toggle switch.

The first central opening 30 has a first champfered end 32 and also a second champfered end 33. To the left of the first central opening 30, there is a second elongated opening 34. The second elongated opening 34 is champfered at 36.

To the right of the first central opening 30, there is a third elongated opening 38. The third elongated opening 38 is champfered at 40.

The openings 34 and 38 are for receiving the screws attaching the control lock 20 to the toggle switch.

The material of construction of the control lock 20 can be a plastic such as a plain plastic or a colored plastic or a plastic which reflects light waves. Also, the control lock 20 can be made of veneers of wood or of metal or veneers of paper such as formica.

Figure 7:
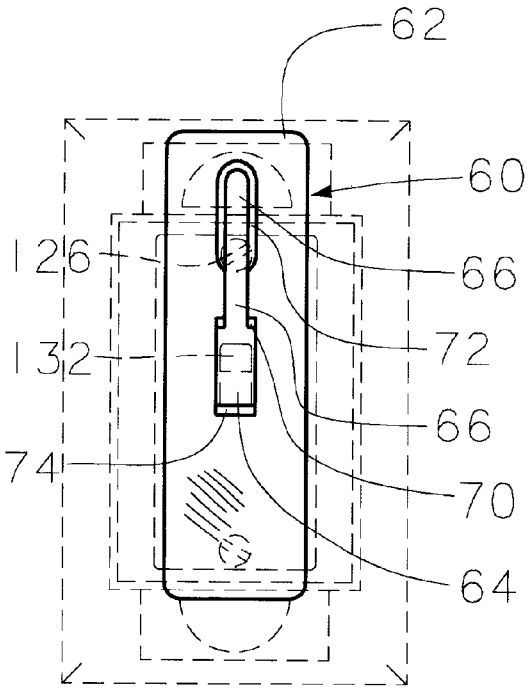
FIG. 7 is a top plan view of another species of the control lock and shows the opening for receiving the projecting lever of the toggle switch joined by a channel to the opening for receiving screws for attaching the control lock to the toggle switch.

In FIG. 7, there is illustrated another form of the control lock 60. There is a strip of material 62. There is a central opening 64 for receiving a projecting lever 132 from a toggle switch 130. Above the opening 64, there is a channel 66 leading to a first elongated opening 68. It is seen that the channel 66 is of a more narrow width than the width of the opening 64 and also of a more narrow width than the width of the first elongated opening 68. The opening 64 has champfered ends 74. Also, the first elongated opening 68 has champfered sides 72.

In the first elongated opening 68, there is a screw 126 for attaching the control lock 60 to the toggle switch 130. Also, it is seen that in FIG. 7 the lower champfered end 74 is pressing against the control lever 32 to restrict the movement of the control lever 32. As illustrated in FIG. 7, the control lever 32 cannot move due to abutting the lower champfered end 74 of the opening 64.

The opening 64, the channel 66, and the first elongated opening 68 are one continuous opening.

Figure 8:
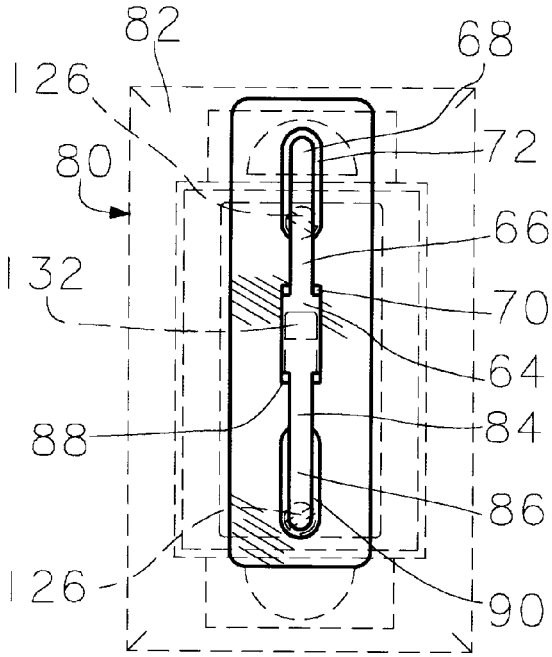
FIG. 8 is a top plan view illustrating another species of the control lock with the central opening for receiving the projecting lever of the toggle switch and above that opening a channel connecting with another elongated opening for receiving a screw for attaching the control lock to the toggle switch and below the opening for the projecting lever a channel for connecting the opening for the projecting lever with a channel for receiving a screws for attaching the control lock to the toggle switch.

In FIG. 8, there is illustrated a control lock 80 comprising a strip of material 82. The control lock 80 comprises a central opening 64 for receiving the projecting lever 132 of the toggle switch 130.

On the upper end of the opening 64, there is a first channel 66 which leads into a first elongated opening 68 which is champfered at 72.

The lower end of the first elongated opening 64 connects with a channel 84 which leads into a second elongated opening 86 which is champfered at 90.

The opening 64 on the upper end is champfered at 70 and on its lower end it is champfered at 88. It is seen that the champfered end 70 is bearing against the projecting lever 132 of the toggle switch 130.

This prevents movement of the toggle switch 132.

There are screws 126 in the openings 68 and 86 so as to firmly position the control lock 80 with respect to the toggle switch 130.

The opening 64, channel 66, opening 68, channel 84, and opening 86 are one continuous opening.

The channel 66 is of a more narrow width than the width of the opening 64 and the width of the opening 68. The channel 84 is of a more narrow width than the opening 64 and the opening 86.

The ends of the opening 64 and also 68 and 86 on bearing against the projecting lever 132 prevent movement of the projecting lever 132.

The opening 86 is champfered at 90.

Figure 5:
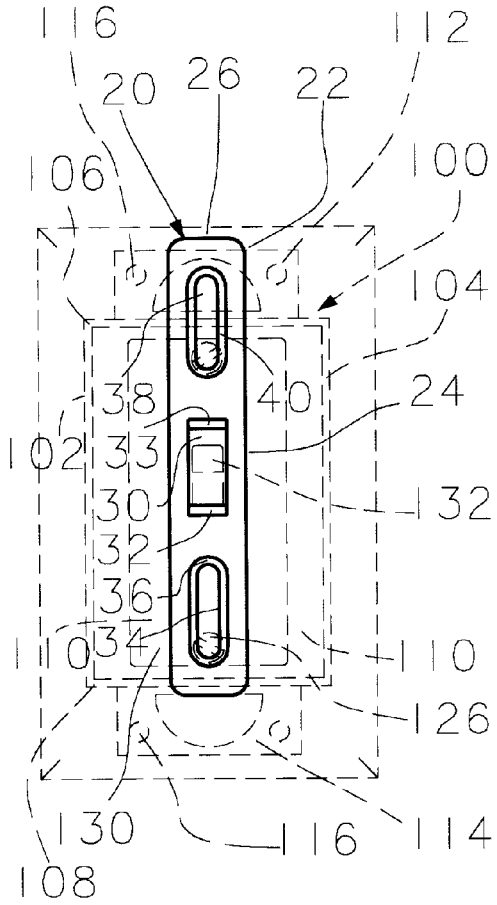
FIG. 5 is a top plan view illustrating the control lock positioned over a mounting receptacle for the toggle switch.
Figure 6:
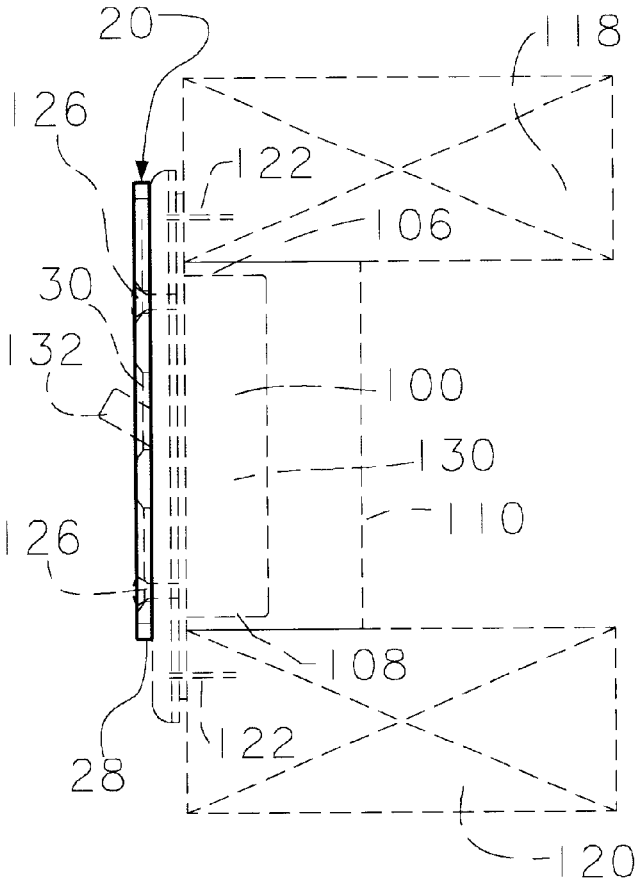
FIG. 6 is a side-elevational illustrating the control lock mounted on the mounting receptacle for the toggle switch.

In FIGS. 5 and 6 there is illustrated a mounting receptacle 100. A toggle switch is normally positioned in a mounting receptacle such as receptacle 100. The receptacle 100 has opposed sides 102 and 104 and has opposed ends 106 and 108. The receptacle 100 has a back wall 110.

The receptacle 100 has an upper mounting strap 112 and a lower mounting strap 114. There are nail holes 116 in the straps 112 and 114.

In FIG. 6, it is seen that there is an upper mounting brace 118 and a lower mounting brace 120. Nails 122 attach the mounting braces 118 and 120 to an upper mounting brace 118 and a lower mounting brace 122. The mounting braces 118 and 122 are of wood and generally of 2-inch by 4-inch wood or 2-inch by 6-inch wood.

There is a cover plate over the toggle switch 130 and also over the control lock 20 for control lock 60 or control lock 80. The cover plate 124 is decorative.

In FIG. 8, the control lock 80 functions both as a cover plate and a control lock. The control lock 80 is wider than the control lock 60 and is wider than the control lock 20 so that the control lock 80 can function as a cover plate as well as a control lock.

There are mounting screws 126 for mounting the control lock on the toggle switch 130.

It is seen that there has bee described and presented a control lock having a central opening with a closed end. The central opening receives the projecting lever of the toggle switch.

There is a means to connect the control lock to the toggle switch. The means normally are screws. In the control lock, there is at least one elongated opening juxtapositioned to the central opening. There may be two elongated opening juxtapositioned to the central opening, one on each end. Then, screws can be positioned in the elongated opening or the elongated openings and screwed into the tapped opening in the control lock.

The toggle switch is mounted in a mounting receptacle. The toggle switch is mounted in the receptacle generally by screws.

The mounting receptacle is attached to the building. If the building be of wood, then the mounting receptacle is attached by nails.

If the building is of metal, then the mounting receptacle can be attached by screws.

To change the position of the control lock with respect to the projecting lever, the screw or screws in the elongated openings can be loosened and the control lock moved so that the appropriate end of the central opening is bearing against the projecting lever so as to prevent movement of the projecting lever. Then, the screw or screws can be tightened so that the control lock is definitely positioned with respect to the projecting lever so as to prevent movement of the projecting lever.

In this way, a closed circuit will remain a closed circuit and an open circuit will remain an open circuit. To change from an open circuit to a closed circuit or from a closed circuit to an open circuit, the screw or screws can be loosened, the projecting lever moved, and the control lock moved so as to have an end of the central opening bearing against the projecting lever. Then, the screw or screws can be tightened so as to firmly position the control lock with respect to the projecting lever.

The control lock 20 may have the following dimensions. The length 24 of the control lock may be 3.725 inches. The width 26 may be 0.625 inches. The thickness 28 may be 0.125 inches. The opening 30 for outside of the champfer is 0.775 inches and inside of the champfer is 0.625 inches. The champfer 33 is 35 degrees. The lengths of the openings 34 and 40 for outside of the champfer may 0.97 inches and inside of the champfer may be 0.900 inches. The widths of the openings 34 and 40 inside of the champfer may be 0.150 inches. The width of the openings 34 and 40 outside of the champfer may be 0.300 inches. The distance from inside of the champfer 33 on the opening 30 to the end of the nearer end 26 may be 1.550 inches. The distance from inside of the champfer 33 and the opening 30 to the inside of the champfer for the opening 38, the longer distance, may be 1.325 inches.

Again, the material of construction of the control lock 20 may be one of many such as the suitable like a clear plastic or a plastic which reflects light; a piece of metal; a pressed paper; and/or veneers of wood or other suitable material.

A control lock for a toggle switch having a projecting lever capable of moving from a first position to a second position and capable of moving from said second position to said first position and comprising a first opening for receiving said projecting lever; said first opening having a first end and a second end; and said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; and a means for operatively connecting said control lock to said toggle switch.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; a second opening adjacent said first end of said first opening; and a third opening adjacent said second end of said first opening.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; and said control lock being at least as wide as said toggle switch and said control lock may be sufficiently wide to function as a cover plate for said switch.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; and said control lock being less wide than the width of said toggle switch.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; and said control lock being of a thickness less than the height of said projecting lever.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; a means for operatively connecting said control lock to said toggle switch; a second opening adjacent said first end of said first opening; a third opening adjacent said second end of said first opening; said control lock being at least as wide as said toggle switch and said control lock may be sufficiently wide to function as a cover plate for said switch; and said control lock being of a thickness less than the height of said projecting lever.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; a means for operatively connecting said control lock to said toggle switch; a second opening adjacent said first end of said first opening; a third opening adjacent said second end of said first opening; said control lock being less wide than the width of said toggle switch; and said control lock being of a thickness less than the height of said projecting lever.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; said first opening comprising a first channel connecting with a first elongated opening; said first elongated opening being capable of receiving a first means for operatively connecting said control lock and said toggle switch; and said opening for receiving said projecting lever, said first channel and said first elongated opening being said first opening.

A control lock for a toggle switch having a projecting lever capable of moving from a first position to a second position and capable of moving from said second position to said first position and comprising a first opening for receiving said projecting lever; said first opening having a first end and a second end; said first opening being of sufficient length to allow said control lock to be positioned at different positions with respect to said projecting lever to allow said projecting lever to be moved between said first position and said second position and also to allow said projecting lever to be moved between said second position and said first position and also to have one end of said first end and said second end juxtapositioned to said projecting lever to restrict the movement of said projecting lever; said first opening comprising a first channel connecting with a first elongated opening; said first elongated opening being capable of receiving a first means for operatively connecting said control lock and said toggle switch; said opening for receiving said projecting lever, said first channel and said first elongated opening being said first opening; said first opening comprising a second channel connecting with a second elongated opening; said second elongated opening being capable of receiving a second means for operatively connecting said control lock and said toggle switch; and said opening for receiving said projecting lever, said first channel, said second channel, said first elongated opening and said second elongated opening being said first opening.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; and forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and making provision for operatively connecting said control lock to said toggle switch.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming a second opening adjacent said first end of said first opening; and forming a third opening adjacent said second end of said first opening.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be at least as wide as said toggle switch and said control lock may be sufficiently wide to function as a cover plate for said switch.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be less wide than the width of said toggle switch.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be of a thickness less than the height of said projecting lever.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; making provision for operatively connecting said control lock to said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; and forming said control lock to be of a thickness less than the height of said projecting lever.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; making provision for operatively connecting said control lock to said toggle switch; forming a second opening adjacent said first end of said first opening; forming a third opening adjacent said second end of said first opening; forming said control lock to be less wide than the width of said toggle switch; and forming said control lock to be of a thickness less than the height of said projecting lever.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming said first opening to comprise a first channel connecting a first elongated opening; forming said first elongated opening to be capable of receiving a first means for operatively connecting said control lock and said toggle switch; and said opening for receiving said projecting lever, said first channel and said first elongated opening being said first opening.

A process for making a control lock for a toggle switch having a projecting lever capable of moving from a first position to a second position and capable of moving from said second position to said first position, said process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming said first opening to comprise a first channel connecting a first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with a second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

A control lock for a toggle switch having a projecting lever capable of moving form a first position to a second position and capable of moving from said second position to said first position and made by a process comprising forming a first opening for receiving said projecting lever; forming said first opening to have a first end and a second end; and forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and making provision for operatively connecting said control lock to said toggle switch.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming a second opening adjacent said first end of said first opening; and forming a third opening adjacent said second end of said first opening.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be at least as wide as said toggle switch and said control lock may be sufficiently wide to function as a cover plate for said switch.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be less wide than the width of said toggle switch.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and forming said control lock to be of a thickness less than the height of said projecting lever.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; making provision for operatively connecting said control lock to said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; and forming said control lock to be of a thickness less than the height of said projecting lever.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; making provision for operatively connecting said control lock to said toggle switch; forming a second opening adjacent said first end of said first opening; forming a third opening adjacent said second end of said first opening; forming said control lock to be less wide than the width of said toggle switch; and forming said control lock to be of a thickness less than the height of said projecting lever.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming said first opening to comprise a first channel connecting with said first elongated opening; forming said first elongated opening to be capable of receiving a first means for operatively connecting said control lock and said toggle switch; and said opening for receiving said projecting lever, said first channel and said first elongated opening being said first opening.

A control lock for a toggle switch having a projecting lever capable of moving form a first position to a second position and capable of moving from said second position to said first position and made by a process comprising forming a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; forming said first opening to comprise a first channel connecting with said first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with said second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and a connecting means for operatively connecting said control lock and said toggle switch.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; a second opening adjacent said first end of said first opening; and a third opening adjacent said second end of said first opening.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; a cover plate for said toggle switch and said cover plate operatively connecting with said toggle switch; and said cover plate being positioned between said control lock and said toggle switch.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; and said control lock being at least as wide as said toggle switch and said control lock may be sufficiently wide to function as a cover plate for said switch.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; and said control lock being less wide than the width of said toggle switch.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; and said control lock being of a thickness less than the height of said projecting lever.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; a second opening adjacent said first end of said first opening; a third opening adjacent said second end of said first opening; and said control lock being of a thickness less than the height of said projecting lever.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; a second opening adjacent said first end of said first opening; a third opening adjacent said second end of said first opening; said control lock being of a thickness less than the height of said projecting lever; a cover plate for said toggle switch and said cover plate operatively connecting with said toggle switch; and said cover plate being positioned between said control lock and said toggle switch.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; said first opening comprising a first channel connecting with a first elongated opening; said first elongated opening being capable of receiving a first means for operatively connecting said control lock and said toggle switch; and said opening for receiving said projecting lever, said first channel and said first elongated opening being said first opening.

A combination of a control lock and a toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a connecting means for operatively connecting said control lock and said toggle switch; said first opening comprising a first channel connecting with a first elongated opening; said first elongated opening being capable of receiving a first means for operatively connecting said control lock and said toggle switch; said opening for receiving said projecting lever, said first channel and said first elongated opening being said first opening; said first opening comprising a second channel connecting with a second elongated opening; said second elongated opening being capable of receiving a second means for operatively connecting said control lock and said toggle switch; and said opening for receiving said projecting lever, said first channel, said second channel, said first elongated opening and said second elongated opening being said first opening.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and providing a connecting means for operatively connecting said control lock and said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and operatively connecting said control lock and said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming a second opening adjacent said first end of said first opening; and forming a third opening adjacent said second end of said first opening.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be at least as wide as said toggle switch and said control lock may be sufficiently wide to function as a cover plate for said switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be less wide than the width of said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be of a thickness less than the height of said projecting lever.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; positioning a cover plate between said control lock and said toggle switch; and operatively connecting said control lock, said cover plate and said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; operatively connecting said control lock and said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; forming said control lock to be of a thickness less than the height of said projecting lever; positioning a cover plate between said control lock and said toggle switch; and operatively connecting said control lock, said cover plate and said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; operatively connecting said control lock and said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; forming said control lock to be of a thickness less than the height of said projecting lever; positioning a cover plate between said control lock and said toggle switch; and operatively connecting said control lock, said cover plate and said toggle switch.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming said first opening to comprise a first channel connecting a first elongated opening; forming said first elongated opening to be capable of receiving a first means for operatively connecting said control lock and said toggle switch; and said opening for receiving said projecting lever, said first channel and said first elongated opening being said first opening.

A process for making a combination of a control lock and a toggle switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming said first opening to comprise a first channel connecting a first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with a second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; and providing a connecting means for operatively connecting said control lock and said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and operatively connecting said control lock and said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming a second opening adjacent said first end of said first opening; and forming a third opening adjacent said second end of said first opening.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be at least as wide as said toggle switch and said control lock may be sufficiently wide to function as a cover plate for said switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be less wide than the width of said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; and forming said control lock to be of a thickness less than the height of said projecting lever.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; positioning a cover plate between said control lock and said toggle switch; and operatively connecting said control lock, said cover plate and said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; operatively connecting said control lock and said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; forming said control lock to be of a thickness less than the height of said projecting lever; positioning a cover plate between said control lock and said toggle switch; and operatively connecting said control lock, said cover plate and said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; operatively connecting said control lock and said toggle switch; forming a second opening adjacent said first end of said first opening; forming a third opening adjacent said second end of said first opening; forming said control lock to be less wide than the width of said toggle switch; forming said control lock to be of a thickness less than the height of said projecting lever; positioning a cover plate between said control lock and said toggle switch; and operatively connecting said control lock, said cover plate and said toggle switch.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming said first opening to comprise a first channel connecting a first elongated opening; forming said first elongated opening to be capable of receiving a first means for operatively connecting said control lock and said toggle switch; and said opening for receiving said projecting lever, said first channel and said first elongated opening being said first opening.

A combination of a control lock and a toggle switch made by a process wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a connecting means for operatively connecting said control lock and said toggle switch; forming said first opening to comprise a first channel connecting a first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with a second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; and a second connecting means operatively connecting said toggle switch and said mounting receptacle.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; a second opening adjacent said first end of said first opening; and a third opening adjacent said second end of said first opening.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; a cover plate for said toggle switch and said cover plate operatively connecting with said toggle switch; and said cover plate being positioned between said control lock and said toggle switch.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; and said control lock being at least as wide as said toggle switch and said control lock may be sufficiently wide to function as a cover plate for said switch.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; and said control lock being less wide than the width of said toggle switch.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; and said control lock being of a thickness less than the height of said projecting lever.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; a second opening adjacent said first end of said first opening; a third opening adjacent said second end of said first opening; and said control lock being of a thickness less than the height of said projecting lever.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; a second opening adjacent said first end of said first opening; a third opening adjacent said second end of said first opening; said control lock being of a thickness less than the height of said projecting lever; a cover plate for said toggle switch and said cover plate operatively connecting with said toggle switch; and said cover plate being positioned between said control lock and said toggle switch.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; said first opening comprising a first channel connecting with a first elongated opening; said first elongated opening being capable of receiving a first means for operatively connecting said control lock and said toggle switch; and said opening for receiving said projecting lever, said first channel and said first elongated opening being said first opening.

A combination of a control lock, a toggle switch, and a mounting receptacle for said toggle switch wherein said toggle switch has a projecting lever capable of moving from a first position to a second position and capable of moving from said second position to said first position, said combination comprising said control lock having a first opening for receiving said projecting lever; said first opening having a first end and a second end; said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; a first connecting means for operatively connecting said control lock and said toggle switch; a second connecting means operatively connecting said toggle switch and said mounting receptacle; said first opening comprising a first channel connecting with a first elongated opening; said first elongated opening being capable of receiving a first means for operatively connecting said control lock and said toggle switch; said opening for receiving said projecting lever, said first channel and said first elongated opening being said first opening; said first opening comprising a second channel connecting with a second elongated opening; said second elongated opening being capable of receiving a second means for operatively connecting said control lock and said toggle switch; and said opening for receiving said projecting lever, said first channel, said second channel, said first elongated opening and said second elongated opening being said first opening.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; and providing a second connecting means for operatively connecting said toggle switch and said mounting receptacle.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; operatively connecting said toggle switch and said mounting bracket.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming a second opening adjacent said first end of said first opening; and forming a third opening adjacent said second end of said first opening.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be at least as wide as said toggle switch and said control lock may be sufficiently wide to function as a cover plate for said switch.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be less wide than the width of said toggle switch.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be of a thickness less than the height of said projecting lever.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; positioning a cover plate between said control lock and said toggle switch; and operatively connecting said control lock, said cover plate and said toggle switch.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; forming said control lock to be of a thickness less than the height of said projecting lever; positioning a cover plate between said control lock and said toggle switch; and operatively connecting said control lock, said cover plate and said toggle switch.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; forming a second opening adjacent said first end of said first opening; forming a third opening adjacent said second end of said first opening; forming said control lock to be less wide than said toggle switch; forming said control lock to be of a thickness less than the height of said projecting lever; positioning a cover plate between said control lock and said toggle switch; and operatively connecting said control lock, said cover plate and said toggle switch.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming said first opening to comprise a first channel connecting a first elongated opening; forming said first elongated opening to be capable of receiving a first means for operatively connecting said control lock and said toggle switch; and said opening for receiving said projecting lever, said first channel and said first elongated opening being said first opening.

A process for making a combination of a control lock, a toggle switch, and a mounting receptacle for said switch wherein said toggle switch has a projecting lever capable of moving from a first position to a second position and capable of moving from said second position to said first position, said combination comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming said first opening to comprise a first channel connecting a first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with a second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; and providing a second connecting means for operatively connecting said toggle switch and said mounting receptacle.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; and operatively connecting said toggle switch and said mounting bracket.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming a second opening adjacent said first end of said first opening; and forming a third opening adjacent said second end of said first opening.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be at least as wide as said toggle switch and said control lock may be sufficiently wide to function as a cover plate for said switch.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be less wide than the width of said toggle switch.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; and forming said control lock to be of a thickness less than the height of said projecting lever.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; positioning a cover plate between said control lock and said toggle switch; and operatively connecting said control lock, said cover plate and said toggle switch.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; forming a second opening adjacent said first end of said first opening; forming a third opening adjacent said second end of said first opening; forming said control lock to be at least as wide as said toggle switch and said control lock may be sufficiently wide to function as a cover plate for said switch; forming said control lock to be of a thickness less than the height of said projecting lever; positioning a cover plate between said control lock and said toggle switch; and operatively connecting said control lock, said cover plate and said toggle switch.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; operatively connecting said control lock and said toggle switch; forming a second opening adjacent said first end of said first opening; forming a third opening adjacent said second end of said first opening; forming said control lock to be less wide than said toggle switch; forming said control lock to be of a thickness less than the height of said projecting lever; positioning a cover plate between said control lock and said toggle switch; and operatively connecting said control lock, said cover plate and said toggle switch.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming said first opening to comprise a first channel connecting a first elongated opening; forming said first elongated opening to be capable of receiving a first means for operatively connecting said control lock and said toggle switch; and said opening for receiving said projecting lever, said first channel and said first elongated opening being said first opening.

A combination of a control lock, a toggle switch, and a mounting receptacle for said switch wherein said toggle switch has a projecting lever capable of moving from a first position to a second position and capable of moving from said second position to said first position, said combination made by a process comprising forming said control lock to have a first opening for receiving said projecting lever; forming said first opening to have a first end and a second end; forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever; providing a first connecting means for operatively connecting said control lock and said toggle switch; providing a second connecting means for operatively connecting said toggle switch and said mounting receptacle; forming said first opening to comprise a first channel connecting a first elongated opening; forming said first elongated opening to be capable of receiving a first means for operatively connecting said control lock and said toggle switch; said opening for receiving said projecting lever, said first channel and said first elongated opening being said first opening; forming said first opening to comprise a second channel connecting with a second elongated opening; forming said second elongated opening to be capable of receiving a second means for operatively connecting said control lock and said toggle switch; and said opening for receiving said projecting lever, said first channel, said second channel, said first elongated opening and said second elongated opening being said first opening.

What I claim is:

1. A relatively long, relatively wide, and a relatively thin unity one-piece continuous control lock for a toggle switch having projecting lever capable of moving from a first position to a second position and capable of moving from said second position to said first position and comprising:

a. a first opening for receiving said projecting lever;

b. said first opening having a first end and a second end; and c. said first opening being of sufficient length to allow said control lock to be positioned at different positions with respect to said projecting lever to allow said projecting lever to be moved between said first position and said second position and also to allow said projecting lever to be move between said second position and said first position and also to have one end of said first end and said second end juxtapositioned to said projecting lever to restrict the movement of said projecting lever;

d. said first opening comprising a first channel connecting with a first elongated opening;

e. said first elongated opening being capable of receiving a first means for operatively connecting said control lock and said toggle switch; and f. said opening tor receiving said projecting lever, said first channel and said first elongated opening being said first opening.

2. A process for making a relatively long, relatively wide, and a relatively thin unitary one-piece continuous control lock for a toggle switch having a projecting lever capable of moving from a first position to a second position and capable of moving from said second position to said first position, said process comprising:

a. forming a first opening for receiving said projecting lever;

b. forming said first opening to have a first end and a second end;

c. forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever;

d. forming said first opening to comprise a first channel connecting a first elongated opening;

e. forming said first elongated opening to be capable of receiving a first means for operatively connecting said control lock and said toggle switch; and c. said opening for receiving said projecting lever, said first channel and said first elongated opening being said first opening.

3. A combination of a relatively long, relatively wide, and a relatively thin unitary one-piece continuous control lock and a toggle switch wherein said toggle switch has a projecting lever capable of moving from a first position to a second position and capable of moving from said second position to said first position, said combination comprising:

a. said control lock having a first opening for receiving said projecting lever;

b. said first opening having a first end and a second end;

c. said first opening being of sufficient length to allow said control lock to be positioned at different positions with respect to said projecting lever to allow said projecting lever to be moved between said first position and said second position and also to have one end of said first end and said second end juxtapositioned to said projecting lever to the movement of said projecting lever; and d. a connecting means for operatively connecting said control lock and said toggle switch;

e. said first opening comprising a first channel connecting with a first elongated opening;

f. said first elongated opening being capable of receiving a first means for operatively connecting said control lock and said toggle switch; and g. said opening for receiving said projecting lever, said first channel and said first elongated opening being said first opening.

4. A process for making a combination of a relatively long, relatively wide, and a relatively thin unitary one-piece continuous control lock and a toggle switch wherein said toggle switch has a presenting lever capable of moving from a first position to a second position and capable of moving from said second position to said first position, said combination comprising:

a. forming said control lock to have a first opening for receiving said projecting lever;

b. forming said first opening to have a first end and a second end;

c. forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever;

d. providing a connecting means for operatively connecting said control lock and said toggle switch;

e. forming said first opening to comprise a first channel connecting a first elongated opening;

f. forming said first elongated opening to be capable of receiving a first means for operatively connecting said control lock and said toggle switch; and g. said opening for receiving said projecting lever, said first channel and said first elongated opening being said first opening.

5. A combination of a relatively long, relatively wide, and a relatively thin unitary one-piece continuous control lock, a toggle switch, and a mounting receptacle for said toggle switch wherein said toggle switch has a projecting lever capable of moving from said first position to a second position and capable of moving from said second position to said first position, said combination comprising:

a. said control lock having a first opening for receiving said projecting lever;

b. said first opening having a first end and a second end;

c. said first opening being of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever;

d. a first connecting means for operatively connecting said control lock and said toggle switch;

e. a second connecting means operatively connecting said toggle switch and said mounting receptacle;

f. said first opening comprising a first channel connecting with a first elongated opening;

g. said first elongated opening being capable of receiving a first means for operatively connecting said control lock and said toggle switch; and h. said opening for receiving said projecting lever, said first channel and said first elongated opening being said first opening.

6. A process for making a combination of a relatively long, relatively wide, and a relatively thin unitary one-piece continuous control lock, a toggle switch, and a mounting receptacle for said switch wherein said toggle switch has a projecting lever capable of moving from a first position to a second position and capable of moving from said second position to said first position, said combination comprising:

a. forming said control lock to have a first opening for receiving said projecting lever;

b. forming said first opening to have a first end and a second end;

c. forming said first opening of sufficient length to allow said control lock to be positioned at different positions with respect to said projecting lever to allow said projecting lever to be moved between said first position and said second position and also to have one end of said first end and said second end juxtapositioned to said projecting lever to restrict the movement of said projecting lever;

d. providing a first connecting means for operatively connecting said control lock and said toggle switch;

e. providing a second connecting means for operatively connecting said toggle switch and said mounting receptacle;

f. forming said first opening to comprise a first channel connecting a first elongated opening;

g. forming said first elongated opening to be capable of receiving a first means for operatively connecting said control lock and said toggle switch; and h. said opening for receiving said projecting lever, said first channel and said first elongated opening being said first opening.

* * * * *